United States Patent [19]

Bodnar

[11] 4,200,775

[45] Apr. 29, 1980

[54] PRESSURE RESPONSIVE SWITCH WITH LOW PRESSURE CUTOFF

[75] Inventor: Michael Bodnar, West Chicago, Ill.

[73] Assignee: Furnas Electric Company, Batavia, Ill.

[21] Appl. No.: 916,759

[22] Filed: Jun. 19, 1978

[51] Int. Cl.[2] ..... H01H 35/34

[52] U.S. Cl. ..... 200/83 S; 200/83 Wm

[58] Field of Search ..... 200/83 R, 83 P, 83 S, 200/83 SA, 83 WM, 83 Z, 81.5, 61.2

[56] References Cited

U.S. PATENT DOCUMENTS

| | | | |
|---|---|---|---|
| 3,139,493 | 6/1964 | Krieger, Sr. et al. | 200/83 SA |
| 3,875,358 | 4/1975 | Willcox | 200/83 P |

*Primary Examiner*—Gerald P. Tolin

[57] ABSTRACT

A pressure responsive switch includes a diaphragm exposed to a pressure source and operating combination of levers to open and close a switch at predetermined pressure values. To prevent operation of a pump motor at abnormally low values, an element is provided between the diaphragm and the switch operating means to open the contacts.

5 Claims, 7 Drawing Figures

PRESSURE RESPONSIVE SWITCH WITH LOW PRESSURE CUTOFF

BACKGROUND OF THE INVENTION

This invention relates generally to automatic control devices. More specifically it relates to improvements in pressure responsive electrical switches.

In U.S. Pat. No. 3,875,358 a fluid or gas pressure responsive switch is disclosed effective to control a pump or compressor so as to maintain the pressure in a system between predetermined limits.

It has been found that the performance of a system incorporating the invention of U.S. Pat. No. 3,875,358 and the protection afforded thereby can be improved by the provision of means which prevents operation of the switch when the pressure in the system falls below a predetermined amount.

Therefore, it is an object of this invention to provide a novel pressure responsive electrical switch which automatically operates to interrupt an electrical circuit when the pressure in a closed system falls below a predetermined value.

It is another object of this invention to provide a novel pressure responsive electrical switch which requires manual intervention, insuring that safe conditions are obtained before a switch can resume its automatic control.

BRIEF SUMMARY OF THE INVENTION

Briefly this invention comprises an automatic pressure responsive switch, including a diaphragm exposed to and responsive to the pressure in a closed system acting through a mechanical linkage against the force of the biasing spring causing switch contacts to close when the pressure in the system falls below a predetermined value and to open when the pressure exceeds a different predetermined value. A safety cutoff is provided which is effective when the pressure in the system falls below a third predetermined value lower than that of the first to again cause the switch contacts to open. Associated with the safety cutoff is a manually operable means to close the contacts after the fault causing the safety cutoff to operate in the first instance has been corrected.

BRIEF DESCRIPTION OF THE DRAWINGS

The invention itself as set forth in the claims which are appended hereto and form a part of the specification while an understanding of the embodiment thereof may be had by reference to the detailed description taken in conjunction with the drawings in which:

DETAILED DESCRIPTION

Figure 1:
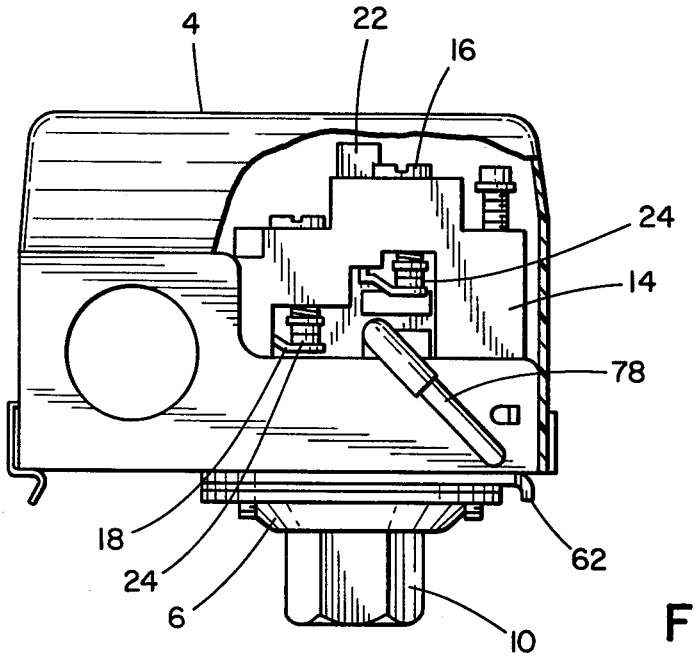
FIG. 1 is a side view partially cut away of an embodiment of the invention.
Figure 2:
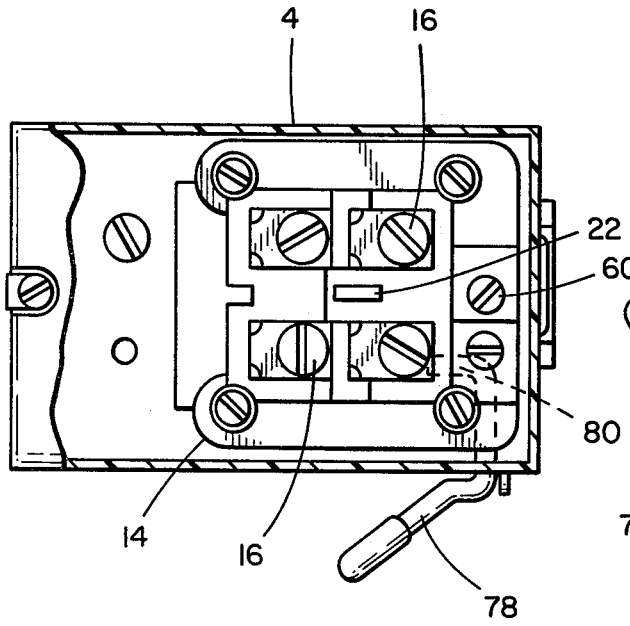
FIG. 2 is a partial sectional plan view of the embodiment of FIG. 1.
Figure 3:
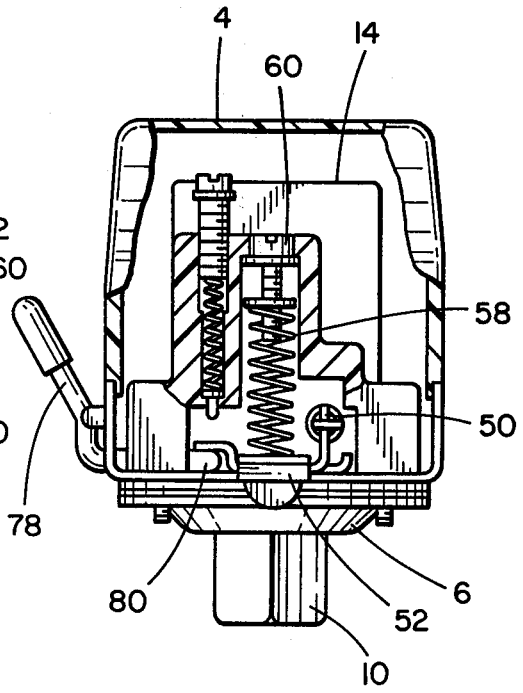
FIG. 3 is a partial sectional end view of the embodiment of FIG. 1.

Because the pressure responsive switch shown herein in its basic construction is substantially identical with that shown in U.S. Pat. No. 3,875,358, the basic switch and its mode of operation will be only generally described. For a more complete explanation of the structure and operation of the switch attention is directed to the above identified patent.

Thus a switch in accordance with the invention comprises a frame or support 2 which may be provided with a removable cover 4 to protect the switch mechanism. Mounted on the bottom of the frame is a diaphragm enclosure assembly 6 which is held to the frame by means of screws 8. A threaded or other similar element 10 is attached to the diaphragm enclosure 6 in order that the switch may be connected to a conduit or similar device whereby fluid or gas in the conduit may have access to the undersurface of a diaphragm 12. The diaphragm is clamped around its periphery between the diaphragm housing and frame 2 and provides a seal between the conduit and the switch.

Figure 4:
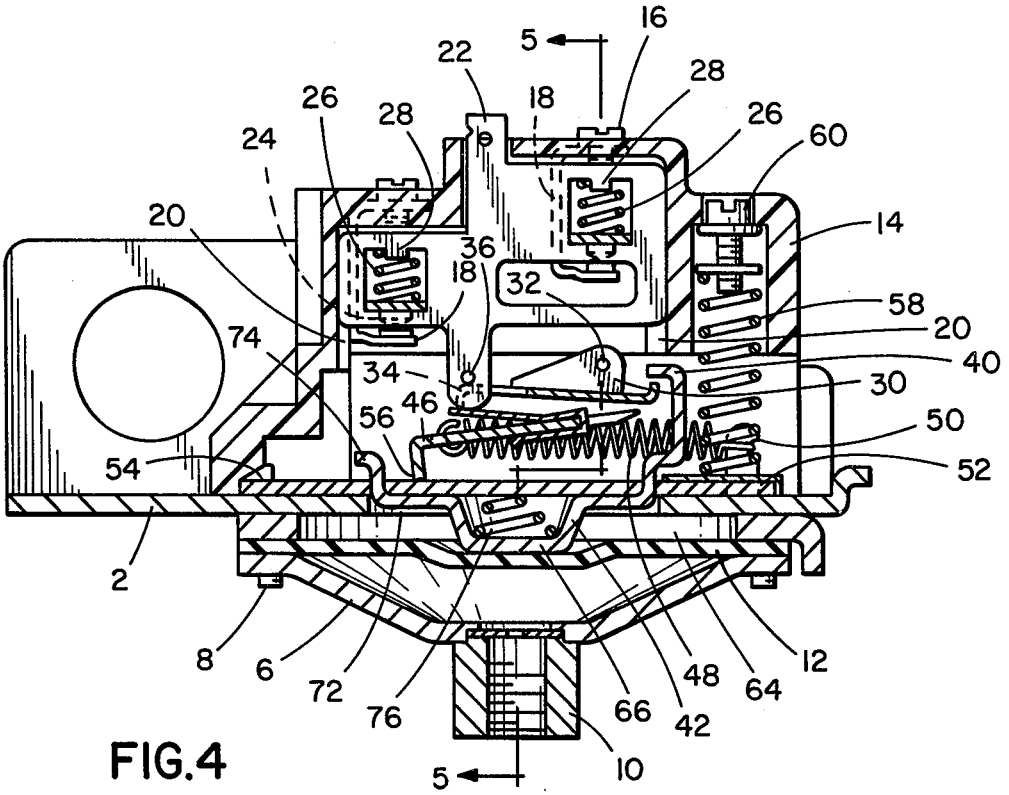
FIG. 4 is a sectional view of the embodiment of FIG. 1 with the cover removed.
Figure 5:
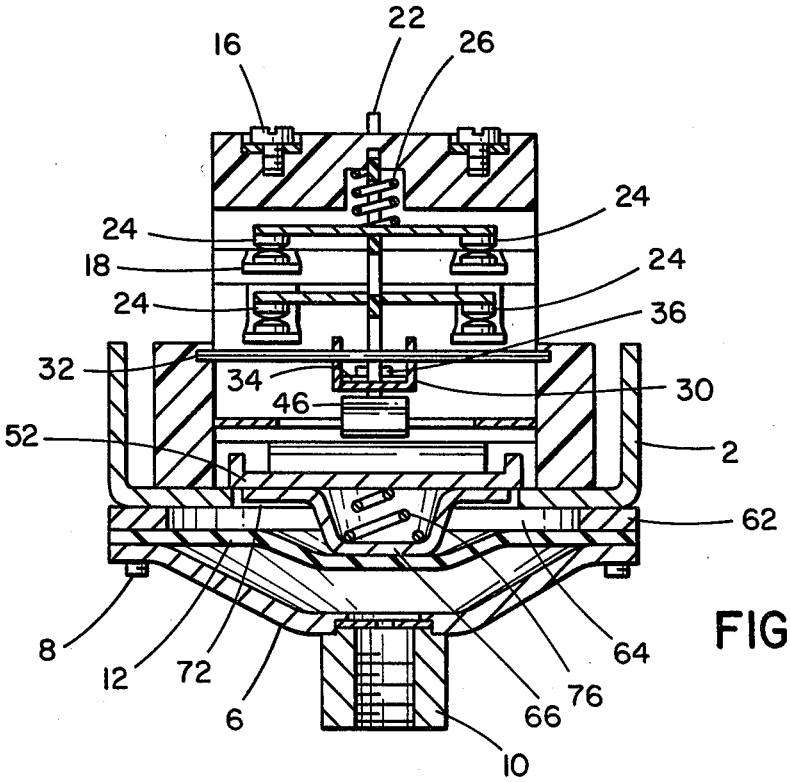
FIG. 5 is a view along the lines 5—5 of FIG. 4.
Figure 6:
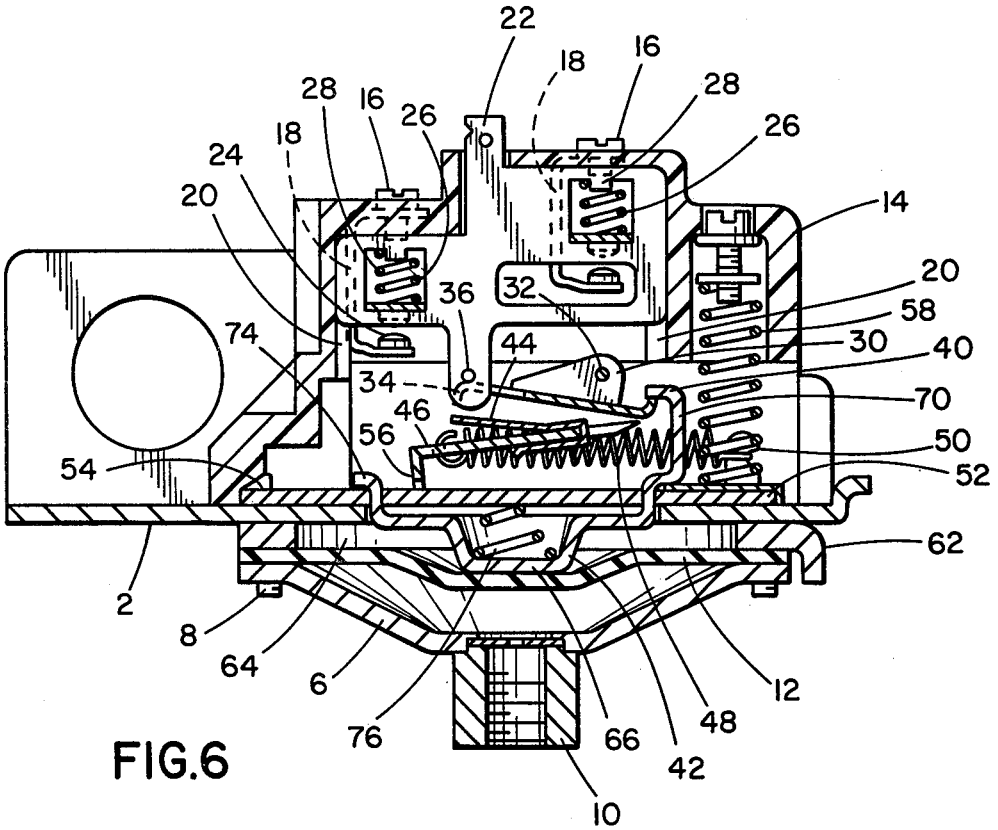
FIG. 6 is a sectional view similar to FIG. 4 illustrating the position of the components during a particular phase of its operation.
Figure 7:
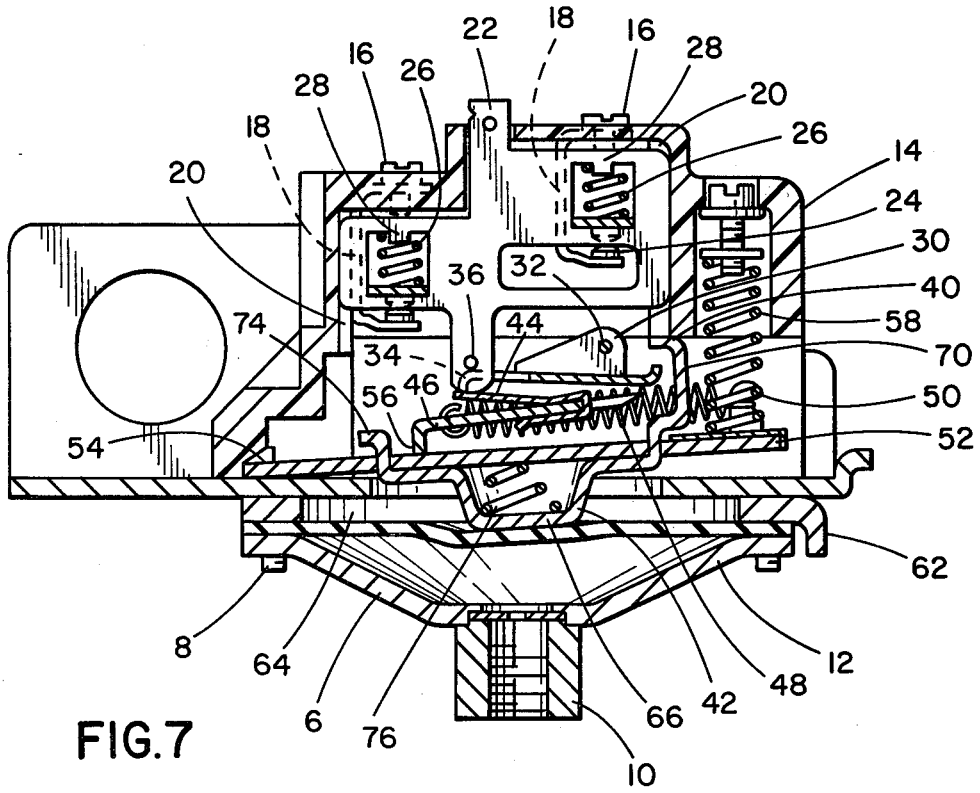
FIG. 7 is a view similar to FIG. 6 illustrating the components during a different phase of its operation.

The switch includes a support structure 14 formed out of any plastic material having suitable mechanical and electrical insulating properties. The support structure 14 has provided on its upper surface a plurality of terminals 16 to which are connected generally U-shaped stationary contacts 18 which extend into the support structure. Mounted in the support structure and vertically movable in oppositely disposed guide slots 20 is a contact carrier 22 which carries movable contacts 24 corresponding in number to the number of stationary contacts 18 and held in position by springs 26 which themselves are retained by virtue of their engagement with bosses 28. As may be seen, as the contact carrier 22 moves either up or down the stationary and movable contacts are interrupted as shown in FIG. 6 or are engaged as shown in FIGS. 4 and 7.

The contact carrier 22, and consequently the movable contacts are normally held in an upward, contact open, position by an actuating lever 30 pivotally mounted at 32 on the support structure 14. This is effected by the engagement of one end 34 of the actuating lever with a boss 36 formed on the bottom of the carrier. The other end 38 of the actuating lever is positioned under a horizontal portion 40 of a dome-like element 42 in contact with the diaphragm 12 and is restrained from counterclockwise rotation by that portion. Urging the actuating lever 30 in a clockwise direction and, therefore, urging the carrier 22 upward is a leaf spring 44 bearing against the actuating lever end 24. The spring 44 is formed with a U-shaped end holding it on a flipper 46.

The flipper 46 is normally urged in a counterclockwise direction by a coil spring 48 attached to the flipper at one end and upstanding lug 50 on a main lever 52 at the other end. The lever 52 is pivotable about an end 54 engaged in a recess in the support 14. With the flipper urged counterclockwise, normally an end 56 thereof engages the upper surface of the main lever 52. The lever 52 itself is urged downwardly about its pivoting end 54 by the action of a main spring 58. A threaded element 60 in the support 14 permits the force exerted by the spring 58 to be adjusted.

In the quiescent state, that is, with no fluid or gas flowing in a system to which the element 10 is connected, the spring 58 forces the main lever 52 downward against the bottom of the frame 2. The flipper 46 is pulled counterclockwise by the spring 48 while the leaf spring 44 on the flipper engages the end 34 of the actuating lever 30, urging that actuating lever clockwise and upward against the boss 36 on the carrier 22, and the contacts are in a normally opened position as shown in FIG. 6.

As pointed out previously, the diaphragm is held at its periphery by the diaphragm enclosure 6. Spaced between the diaphragm enclosure 6 and the frame 2 is a spacer plate 62 having a central opening 64 through which the dome-like element 42 extends. This element is constituted by a dome portion 66 bearing against the upper surface of the diaphragm and a pair of legs 68 and 70. One leg 70 extends a greater distance than the other leg 68 and carries the horizontal portion 40 referred to above. The legs 68 and 70 extend through openings in the main lever 52 and relative movement of the element 42 and lever 52 is permitted for a distance determined by the space between horizontal portions 72 and 74 of the element 42 extending, respectively, below and above the lever. A spring 76 is positioned between the bottom of the main lever 52 and the domed portion 66 to urge the domed portion away from the lever 52.

A particular aspect of this invention is the provision of a reset means constituted in part by a lever 78 rotatably mounted in the frame 2 and extending under a portion of the main lever 52 to provide a rotatable crank arm 80. When the lever 78 is rotated clockwise as shown in FIG. 1, the crank arm 80 rotates in the same direction to cause the main lever 52 to rotate slightly counterclockwise about its pivot 54 against the force of the spring 58.

With the switch assembly installed in a system and it is desired to close the contacts to energize a motor driving a fluid or air pump, the lever 78 is rotated clockwise pivoting the lever 52. When that lever is pivoted its top surface engages the bottom surface of the leg 70 of the element 42, raising the horizontal portion 40 to remove the restraint against counterclockwise movement of the actuating lever 30 (see FIGS. 6 and 7), thereby permitting the contact carrier 22 to move downwardly and close the contacts. The pump motor is then started and fluid pressure begins to build up in the system. When a desired fluid pressure has been established the diaphragm 12 flexes upwardly, and the lever 52 is slightly rotated against the force of the spring 58. The contacts remain closed and the pump motor continues to operate. As pressure continues to build up in the system the diaphragm flexes upwardly still further against the force of the spring 76 until the horizontal portion 72 of the dome-like element 40 engages the undersurface of the main lever 52. If the pressure in the system should exceed a predetermined value determined by the force exerted by the spring 58, the diaphragm will move further upwardly and the dome-like structure will now cause the lever 52 to rotate further in a counterclockwise direction. That rotation will continue and in the process cause the flipper 46 to rotate in a clockwise direction until the center line of the spring 48 passes a predetermined point, at which point the flipper will operate with a snap action, bringing the leaf spring 44 into contact with the end 34 of the actuating lever 30. Movement of the flipper and leaf spring will then cause the contact carrier 22 to move upwardly, opening the contacts and interrupting the circuit to the pump motor. As pressure in the system drops the main lever 52 is permitted to rotate downwardly clockwise to a point where the flipper 46 moves counterclockwise with a snap action permitting the contact carrier to move downwardly and reestablish the circuit. In this manner the pressure in the system is maintained at a desired value between upper and lower limits.

In particular accordance with this invention, the elements described provide a safety means to prevent continued operation of a pump motor and its possible destruction or damage in the event that the pressure in the system drops abnormally low. As has been pointed out, when the pressure in the system drops below a predetermined value the contacts are closed to start the motor and the motor will, of course, operate until the desired pressure is reached. If there should be some damage to the fluid or gas system, as, for instance, a leak, of course the pressure will not rise and the motor will continue to run and it may overheat and be damaged or destroyed. To prevent this the switch functions as follows. When the pressure drops below a predetermined value, lower than the normal switch closing value, the spring 76 expands, moving the dome-like element 42 downwardly away from the main lever 52 (see FIG. 6). With the downward movement of the dome-like element its horizontally extending portion 40 engages the end 38 of the actuating lever 30, causing that lever to rotate clockwise whereby its other end 34 engages the bosses 36 on the contact carrier 22 to open those contacts and shut off the pump.

After whatever fault has occurred to cause the low pressure to exist has been corrected, the system may be restarted in the manner described above.

Thus, as may be seen, the switch normally operates to maintain pressure in the system between a relatively high value and a first low value. If the pressure should drop below a second and still lower value, the switch will open to protect the motor.

Various modifications in design may be made, and it is intended by the claims appended hereto to cover all such modifications as fall within their scope.

What is claimed as new and desired to be secured by Letters Patent is:

1. In a pressure responsive switch having a supporting structure, fixed contacts, a movable contact carrier thereon carrying movable contacts for engagement and disengagement with the fixed contacts, a diaphragm housing and a diaphragm therein, means for connecting the diaphragm housing to pressure source, and means responsive to movement of the diaphragm as the pressure changes in the source to cause the contacts to open and close to maintain the pressure between a predetermined high value and first predetermined low value, the improvement comprising: a main lever pivotable in said supporting structure, adjustable main spring means urging said lever in one direction, a dome-like element having a portion engaging said diaphragm and engageable with the underside of said main lever to cause said main lever to rotate against the force of said main spring means as the diaphragm moves in response to increasing fluid pressure, pivoting means mounted between said main lever and the contact carrier to cause said contact carrier to move the movable contacts away from the fixed contacts when the pressure in the source exceeds the predetermined high value, and to permit movement of said contact carrier to move the movable contacts toward the fixed contacts when the pressure in the source is less than a first predetermined low value, portions of said element extending through openings in said main lever toward said pivoting means and a spring interposed between said element and said main lever for providing for relative movement between said element and said main lever, and means on said element operating said pivoting means upon relative movement of said element and said main lever to cause the contact carrier to move away from the fixed contacts when the pressure in the source is less than a second predetermined low value which in turn is less than the first predetermined low value.

2. In a pressure responsive switch as set forth in claim 1, wherein said pivoting means comprises an actuating lever engageable with said contact carrier, and a spring biased flipper engaging said main lever and said actuating lever.

3. In a pressure responsive switch as set forth in claim 2, wherein said means on said element comprises a portion of said element extending through said main lever and engageable with said actuating lever upon relative movement of said element and said main lever to rotate said actuating lever to move the contact carrier away from the fixed contacts.

4. In a pressure responsive switch as set forth in claim 3, manually operable means for causing the contact carrier to close the contacts.

5. In a pressure responsive switch as set forth in claim 4, wherein said manually operable means comprises a crank pivotally mounted in supporting structure and having a portion engaging said main lever to pivot said main lever.

* * * * *